United States Patent [19]

Hult et al.

[11] Patent Number: 4,726,157

[45] Date of Patent: Feb. 23, 1988

[54] BUILDING

[76] Inventors: Magnus Hult, Slättövägen 28, S-352 52 Växjö; Valter Mannesson, Trädgårdsgatan 7, S-341 00 Ljungby, both of Sweden

[21] Appl. No.: 852,634

[22] PCT Filed: Jul. 23, 1985

[86] PCT No.: PCT/SE85/00294

§ 371 Date: Mar. 21, 1986

§ 102(e) Date: Mar. 21, 1986

[87] PCT Pub. No.: WO86/00948

PCT Pub. Date: Feb. 13, 1986

[30] Foreign Application Priority Data

Jul. 23, 1984 [SE] Sweden ..... 8403828
Jul. 23, 1984 [SE] Sweden ..... 8403829

[51] Int. Cl.[4] ..... E04B 1/24; E04B 1/58

[52] U.S. Cl. ..... 52/79.5; 52/93; 52/274; 52/645

[58] Field of Search ..... 52/79.5, 79.8, 236, 52/93, 299, 274, 92, 645, 665

[56] References Cited

U.S. PATENT DOCUMENTS

| | | | |
|---|---|---|---|
| 2,177,699 | 10/1939 | Fisher | 52/236 |
| 2,362,162 | 11/1944 | Sheldan | 52/274 |
| 3,063,520 | 11/1962 | Freeman | 52/645 X |
| 3,101,817 | 8/1963 | Radek | 52/667 X |
| 3,736,714 | 6/1973 | Brenner | 52/667 |
| 3,778,175 | 12/1973 | Zimmer | 52/645 X |
| 3,798,853 | 3/1974 | Castle | 52/299 X |
| 3,832,811 | 9/1974 | Briel | 52/79.5 X |
| 3,867,047 | 2/1975 | Wightman et al. | 52/667 |
| 4,167,838 | 9/1979 | Metheny | 52/79.5 |
| 4,455,792 | 6/1984 | Pasco | 52/93 X |
| 4,586,300 | 5/1986 | Mullin | 52/93 |
| 4,603,531 | 8/1986 | Nash | 52/274 X |

FOREIGN PATENT DOCUMENTS

| | | | |
|---|---|---|---|
| 2089395 | 6/1982 | United Kingdom | 52/93 |

*Primary Examiner*—J. Karl Bell
*Attorney, Agent, or Firm*—Howson and Howson

[57] ABSTRACT

Building containing a metal framework arranged on a base (20) and including a lower frame (2) and an upper frame (3) and vertical uprights (4) between mentioned frames and coupling devices for joining parts of the frames and the vertical uprights with the frames.

4 Claims, 11 Drawing Figures

BUILDING

TECHNICAL FIELD

This invention relates to an arrangement in buildings raised in one or more floors and in applicable cases provided with a semi-floor and with or without a basement, whereby the building is meant to be erected upon a foundation as a base plate, a cellar, a bedding of compressed shingle, other types of beddings, a sleeper wall or similar. The building comprises a framework including lower frames or sills, uprights and upper frames or capping plates and also, to rigidify the framework, wall panels of a material having good insulation properties against heat and cold, preferably an aerated plastic such as polyurethane or styrene. In applicable cases the building is rigidified by means of system of joists when the building is raised as a primary construction or is a self-supporting building as the matter is in a secondary construction.

BACKGROUND

There is a need for a building which in conclusive manner insulates the inner space from external temperature. There is also a further need to be able to reduce the cost of a building and of course even to reduce the now heavy cost of raising and erecting a building. There is a need for new foundations for buildings which can simplify the foundation and reduce the cost. This need is especially accentuated for foundations for temporary buildings or buildings which are meant to be dismantled and moved for rebuilding. Besides, there is also a need for a base which is improved in safety against earthquake and furthermore, a suitable foundation for the base.

TECHNICAL PROBLEMS

It is well known how one tries to meet the requirements specified when building today where one, to achieve better insulation, applies additional insulation to the building or increases the thickness of insulation material. Furthermore even mechanical devices of simpler kind or of more exclusive kind are often utilized nowadays for heat recovery. These measures naturally cannot reduce the cost of a building and neither of course the cost of the building process, which must therefore be considered as having become more complicated despite increased prefabrication of building sections. If one has to any great extent succeeded in meeting the demands for the insulation and sealing of buildings, one has instead, after utilizing the buildings a while, got other problems such as rot and mildew, for the insulation and sealing of buildings, one has instead, after utilizing the buildings a while, got other problems such as rot and mildew, especially in buildings of wooden construction, which in turn give heavy restoration cost such as for the replacement of windows and doors and even wall beams and wall panels. Despite increased efforts with the insulation and sealing of buildings it has in fact been shown that the buildings are often surprisingly badly seald, which depends upon the material in the buildings and is accentuated by short building times with immediate use of the buildings after they are raised and also often due to the buildings being erected during the wrong time of the year. With regard to the present development within the building industry one must perhaps realize that the material used in buildings is the decisive problem. Here one thinks mainly of wooden members such as wooden beams and uprights, wood fibre panels and other formed building constructions of living materials. In order to avoid these problems and meet the requirements specified a new way of thinking as regards the erection of buildings is apparently necessary.

THE SOLUTION

With a view to achieve an improved building of the kind mentioned the arrangement in accordance with this invention shows several changes concerning the details of the building as concerns the foundation, the framework, as beams, frames, sills and capping plates, uprights and wall panels and in applicable cases system of joists. Thus a foundation according to the invention fulfills the requirements made and shows several advantageous. The cost for a foundation can be reduced as early as when removing excavated material for the base. One does not need to excavate so deeply to achieve a bed, base or similar. Then the foundation can be mounted by means of hand-power and be done by anybody and even without the use of any tools. The foundation can replace the current fondations as a base plate on ground or a bed but above all a sleeper wall or a footing. Thus the foundation according to the invention replaces the base of footing, the bed, for example in the form of a footing which must be anchored deeply, a sleeper wall, etc. and also the system of joists of wood or the current system of joists. A system of joists can be formed as load bearable panels. The arrangement involves an optimal insulation of buildings and at the same time as the building is manufactured and mounted or raised in a simple manner on the building site and in short time and without the use of any specific tools or complicated devices as cranes, without the use of any specific tools or complicated devices as cranes, machinery and a large number of tools. Thus there is no need of specific joining devices, as screws, bolts welding seams or similar. As an assistance tool one can use a club of rubber which can be used for locking of locking devices if such are used and possibly to hit the uprights so the uprights reach their end positions in the recesses. The building can be raised at any time during the year irrespective of weather. Besides the reduced period of construction, which results in low cost for the building, the material cost is also reduced compared with conventional constructions. Heat and cold loss by conduction can be avoided resulting in reduced running expenses due to low consumption of energy. The production of cold for buildings are six times more expensive than the production of heat for heating a building. Thus the building is intended for both cold and heat territories. Furthermore the arrangement can not be affected by moisture, rot, or mildew or insects. The arrangement and thus an erected building according to the invention is also fire-resisting as the material can not be inflammable or require supporting fire to burn, i.e. the materials become extinct by themselves. Furthermore, the building is suitable for a temporary building and is easy to dismantle for moving and rebuilding at a different place. Besides the building is suitable for building in territories where earthquakes often arises. The building is also suitable in countries where the level of technology is low. Thus all necessary equipment for the building and the raising of the building is included in the building. The arrangement and the building are suitable for all kind of buildings as storehouses, houses, both permanent or casual, offices, operation buildings, expensive buildings, low-price buildings, etc. There is also a new need for raising buildings at low cost and low running economy, namely for evacuation purposes, for example when carrying out repairs of existing buildings. Besides, it is easy to build an extension to a building, for example to add working localities or stores.

A building in accordance with the invention is caracterized in that the lower frames and the upper frames of the framework show engagement means meant for the parts of the framework to be able to engage one another and further that the vertical uprights show engagement elements meant to be brought into engagement with the lower frame and the upper frame and in that respect against a stop shown by the lower frame and the upper frame.

According to an another characteristic for the building in accordance with the invention the lower frame is formed as a foundation and consists of a beam of metal, preferably in form of a square-shaped profile which shows recesses, whereby the engagement elements of the vertical uprights are arranged to be able to be brought into said recesses in order to be arranged in engagement with the foundation and that said beam may whenever applicable be arranged to a beam arranged under the first mentioned beam, whereby said second beam preferably is formed of metal and in form of a square-shaped profile which is meant to rest upon the bedding which, for example, is in form of a bedding of compressed shingle.

BRIEF DESCRIPTION OF THE DRAWINGS

Further characteristics for and advantages with the buildng in accordance with the invention will be apparent by an embodiment in the following description of the invention, whereby simultaneous reference will be made to the accompanying schematic drawings, of which

BEST MODE FOR CARRYING OUT THE INVENTION

Figure 1:
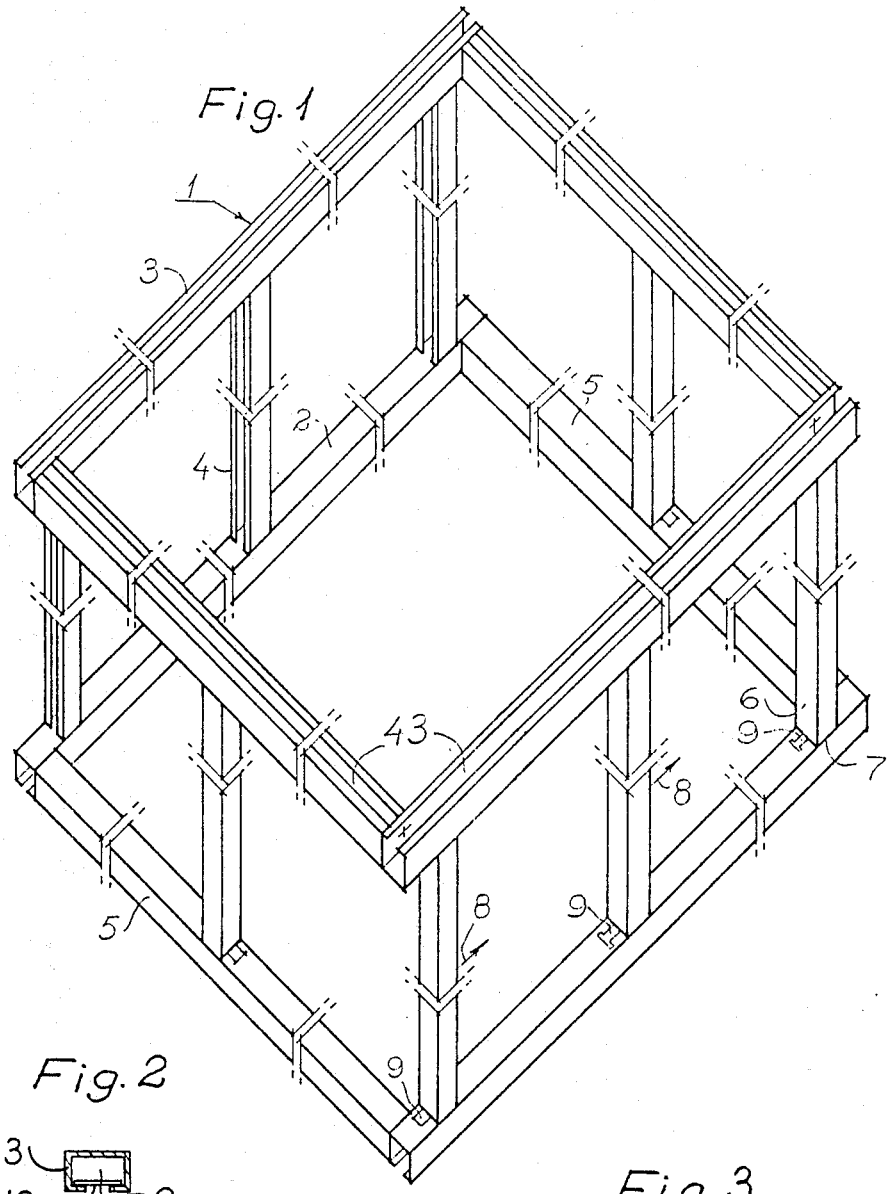
FIG. 1 shows in perspective one embodiment of a framework included in the building according to the invention.

The reference designation 1 in FIG. 1 illustrates a framework including lower frames 2, upper frames 3 and vertical uprights reaching between the frames. The uprights 4 exhibit engagement means 14 arranged in recesses 9 of the lower frames 2 and the upper frames 3 respectively, see also FIG. 4. In this respect the engagement means 14 of the uprights 4 are brought into the recesses 9 and then moved in the recesses against a stop 10, see the arrows 8. One side of the uprights 4 is indicated by the reference designation 6.

Figure 2:
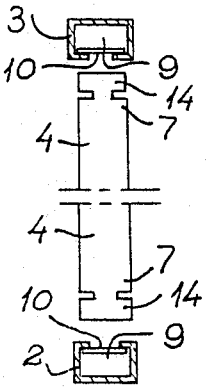
FIG. 2 shows a section through a second embodiment of a framework included in the building.
Figure 3:
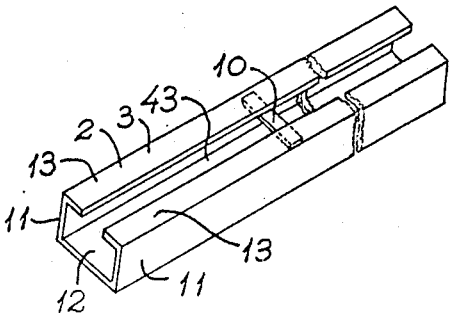
FIG. 3 shows a frame included in the framework shown in FIG. 2.

For utilization of the shown opening 43 of the frames 2, 3, which opening forms a recess 9, the frames according to FIG. 1 are able to be turned 180°, as shown in FIG. 2 and FIG. 3. In this case the engagement elements 14 and the uprights 4 are brought into the openings 43 and are moved against the stops 10 which are shaped or arranged as bridges into the frames. The engagement elements of the uprights are arranged in the lower end and the upper end respectively of the upright. The frames 2, 3 show shanks 11 and a web 12 reaching between the shanks and further flanges 13 directed towards each other. The engagement elements of the uprights can catch behind said flanges.

Figure 4:
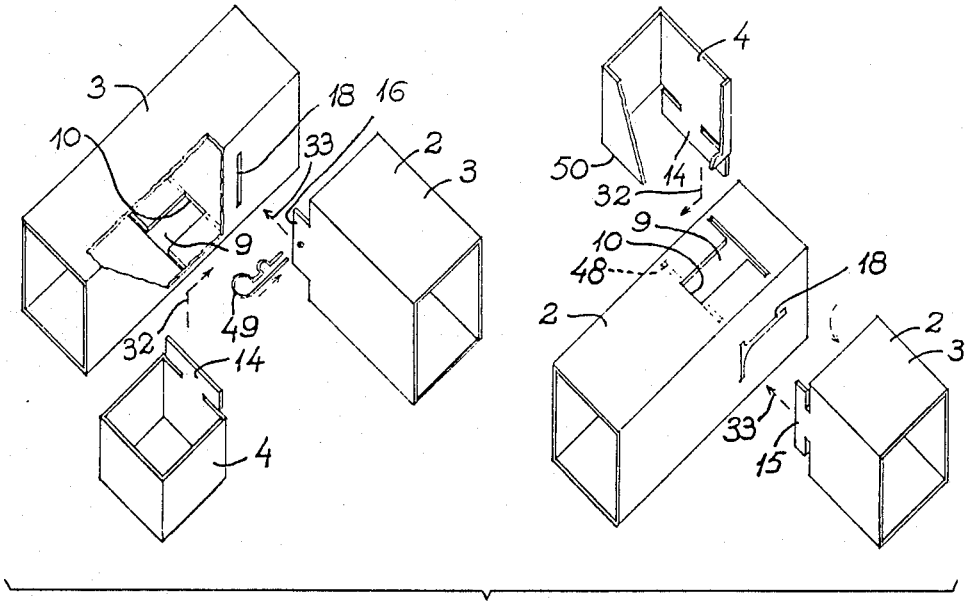
FIG. 4 shows in perspective two examples of parts included in a framework according to one embodiment of the framework, preferably the embodiment shown in FIG. 1.

FIG. 4 show in schematic way how the parts 2, 3 and 4 of the framework 1 are locked to one another by engagement elements 14 and engagement means 15 and 16 in the form of hooking or catching devices or corresponding devices which are brought into holes 18, recesses, slits or openings. The reference designation 48 shows the location of the engagement element 14 of the upright 4 and in that respect in the intended locking position, whereby the upright is joined to an adjacent wall panel 25. According to one of the embodiments there is no need of any locking elements to hold the frames in engagement with one another. A locking element 49 is shown according to the other embodiment.

The same method of locking or connection is utilized when joining the foundation or the beams of the foundation 20, i.e. outer beams 21, inner beams 22 and/or intermediate beams 23, whereby joining means 17, 19 in the form of hooking or catching devices 17 or similar and holes or slits 19 into which the hooking or catching devices can be brought and be hooked or catched and in that respect in the beam. The foundation 20 or the other beams 21 can also be furnished with recesses 9 showing a stop 10, whereby the vertical uprights 4 can be brought and anchored into the foundation.

The arrows 32 illustrates the method of anchoring of the uprights 4 into the frames 2, 3 which can consist of a sill and a capping plate respectively or a corresponding device.

The framework 1, frames 2, 3, uprights 4, 30, foundation 20, beams 21, 22 and 23 can be formed of profiles, tube profiles, preferably square-shaped profiles of metal or plastic material or a composite material, preferably profiles of steel or aluminum, whereby the profiles of aluminum can be continuous pressed. The framework 1 and its parts, as frames 2, 3 and uprights 4 can be formed by sheet-metal, for example galvanized sheet-metal or steel plate which is bended or pressed to the intended shape or to U-shape with flanges 13 or is furnished with recesses 9, etc.

The manufacture of the framework can be made faster than usual as one inter alia can escapes from welding and similar and finishing work of the material. If sheet-metal is used the sheet-metal can be galvanized or coated with nickel already from the beginning compared with the fact that one after the production of parts for a framework, for example uprights, has to carry out galvanizing and nickelling.

Figure 10:
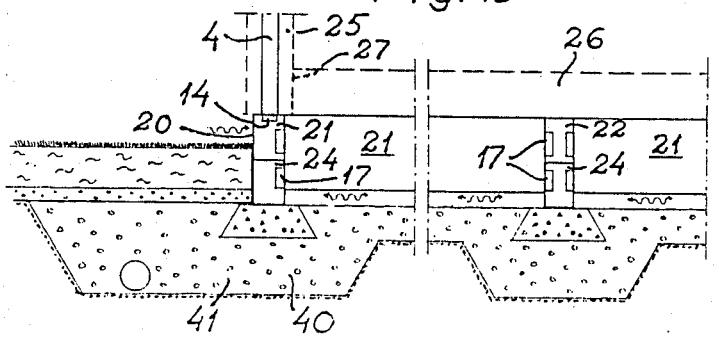
FIG. 10 shows one embodiment of a foundation and a bedding in the building according to the invention and FIG. 11 shows a part of a foundation shaped as a plinth.
Figure 9:
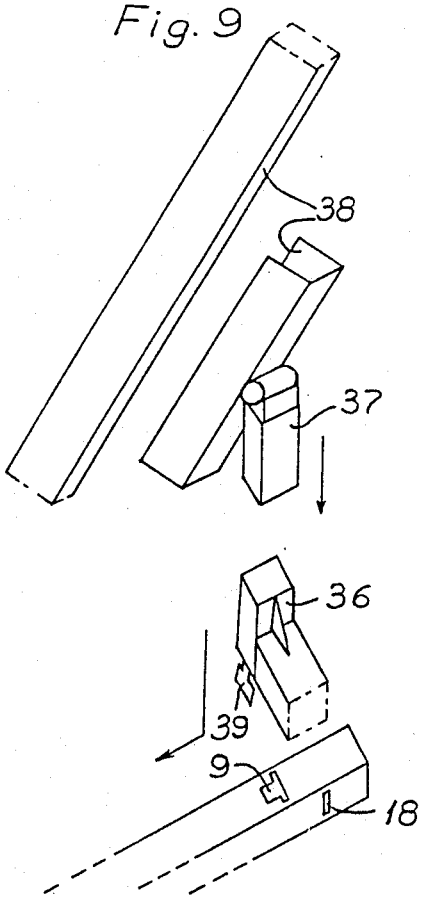
FIG. 9 shows in perspective and in enlarged scale some of the parts shown in FIG. 8, preferably parts of a roof-truss.
Figure 11:
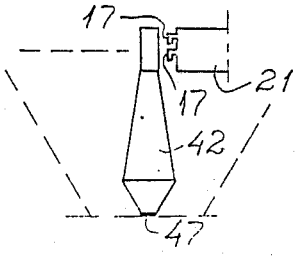

Further, the foundation 20 forms a system of joists by means of the beams 22 and in applicable cases the beams 23, whereby the system of joists is mounted simultaneously as the foundation. The beams of the foundation 20 are formed preferably of standard sizes marketing by wholesalers. As the foundation 20 can be arranged directly on ground it can include a second beam 24 of the lower frame which second beam is arranged or anchored into a bedding 40 or the ground, see also FIGS. 7 and 10.

According to one embodiment the foundation 20 can be arranged upon any suitable base 40 as an asphalt surface, a cellar, plinths, etc. but thus upon a bedding of compressed gravel or a bedding of compressed shingle which bedding can be furnished with a thin layer of concrete for levelling of the foundation 20, as levelling of the vertical line and the horizontal line. By the embodiment shown the foundation and the bedding are going to be easy to arrange and join and further that the foundation can be completely dismantled.

According to one embodiment the lower frames 2 can be arranged or anchored into the foundation 20 or its outer beams 21, for example by means of screws, whereby the frame, for example in a shape of a sill, at the same time serves to stiffen the system of joists.

Upon the foundation 20 is then arranged either a bottom- or a floor-insulation or alternatively a further construction of a system of joists, whereby according to one embodiment bottom-panels or floor-panels 26 are arranged upon the beams and in that respect with theirs free edges 27 adjoining or in connection with wall panels 25. Preferably, the panels 25 and 26, as well as load bearable panels formed to compose a system of joists for an upper floor are formed of a material having good insulation properties against heat and cold. Said bottom-panels 26 can be bordered by a thin steel plate. The foundation 20 can also be arranged or hung to special plinths 42 which are furnished with recesses to receive the joining means 17. By using said plinths 42 one can obtain a complete foundation to frostless depth and in that respect to a cost which is a fractional part compared with a conventional way to make a foundation. The plinths 42 are formed as assymetrical cones with telescopic shape to take up partly compressive forces, partly frictional forces. The plinths can also show a sliding surface 47 to be used for a possible movement by frost. By using said cone with telescopic shape the foundation can also be adjusted by precision and levelled.

Preferably, the bottom-panels 26 are formed in such a way that they with its adjacent end edge 27 faced to wall panels are arranged close to the inner surface of said wall panels 25, i.e. that the wall panels 25 are shaped without that recess which often is shown. Thus, each wall panel 25 is devoided of a recess in the lower portion of the inner surface, see the wall panel 25 in FIG. 8. The wall panel can also be devoided of a lower recess in the bottom edge of the wall panel, whereby the wall panel can rest directly on the foundation 20 or its outer beams 21 with its bottom surface if such a foundation is used. Otherwise, the wall panels exhibit a lower recess so the wall panel can be placed astride the sill or the lower frame 2. The wall panels 25 show an upper recess 35 for receiving the upper frame 3 or capping plates.

Figure 5:
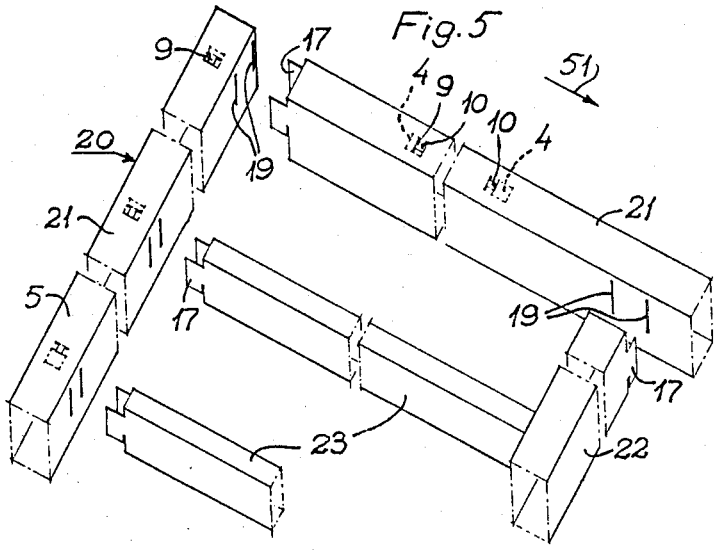
FIG. 5 shows in perspective one embodiment of a foundation included in the building according to the invention.
Figure 6:
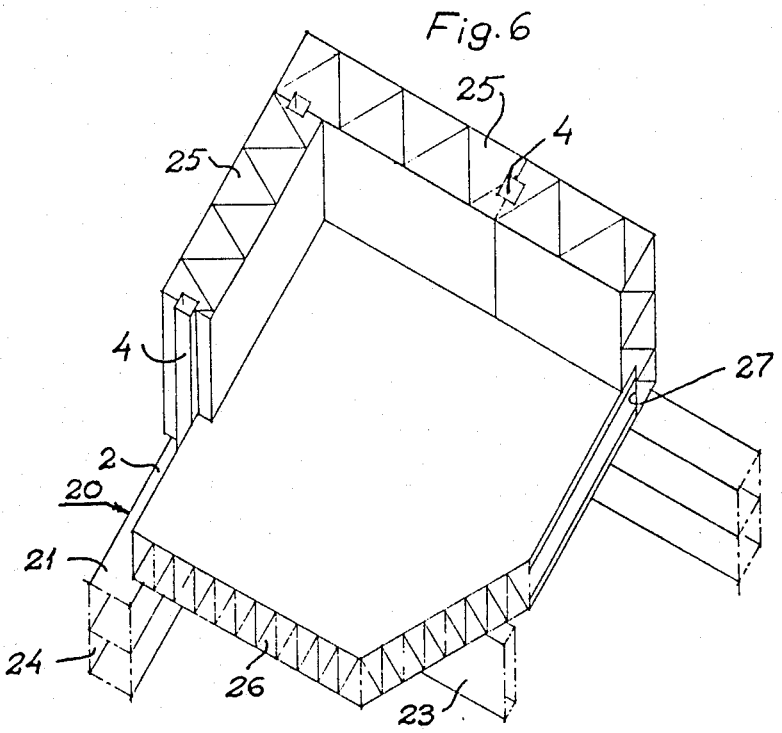
FIG. 6 shows in perspective a part of a building according to one embodiment.

In FIG. 5 and as an alternative in FIG. 4 is shown possible connections between beams or sills. That framework or part of the framework is arranged in the following way. At first the lower beam or sill is anchored to a base, a bedding or a foundation, for example by means of tie irons, bolts, bars, ears, irons or other anchoring devices moulded into the concrete of a foundation. When using the simple method of connection of the beams and sills as shown one begin at first with the beam 5, 21 or a part of the beam for a first wall, a long wall 5. After that at least one beam 21 or a part of the beam and at least some intermediate beams 23 are connected to the beam 5 until a possible inner beam 22 is reached and so on in the direction shown by the arrow 51. The arrow 33 show the joining of a beam to an another beam in the foundation 20. The assemblage is continued in the same way until the last beam is arranged by for example hooking to connecting beams. Only a certain breadth can be assembled at a time and only a part of the frame or foundation until full breadth is reached.

According to one embodiment the beams of the lower frame 2 are anchored, for example by means of screws or bolts, to a beam 24 arranged under said first beam. Said second beam is formed as a square-shaped profile or an I-shaped beam, for example formed by two U-shaped profiles which are joined together. Said beam 21 can be used as a sleeper wall, a base or similar and in turn anchored into the bedding 40 or the foundation 20 (maybe a base plate) by means of anchoring devices of the kind mentioned before.

When the foundation and the system of joists have been arranged or assembled the rest of the framework is assembled. The walls shall naturally include material, preferably in form of panels, but the framework can be used in conventional construction work using earlier known and applied technology construction. The panels show edge recesses 31 in the joint edges of the wall panels, whereby two adjacent wall panels can be arranged to enclose an upright longitudinally. The lower part of the uprights 4 show engagement elements 14 formed to obtain a simple assemblage, whereby the upright is brought into a recess 9 and moved to an end position as shown.

Figure 8:
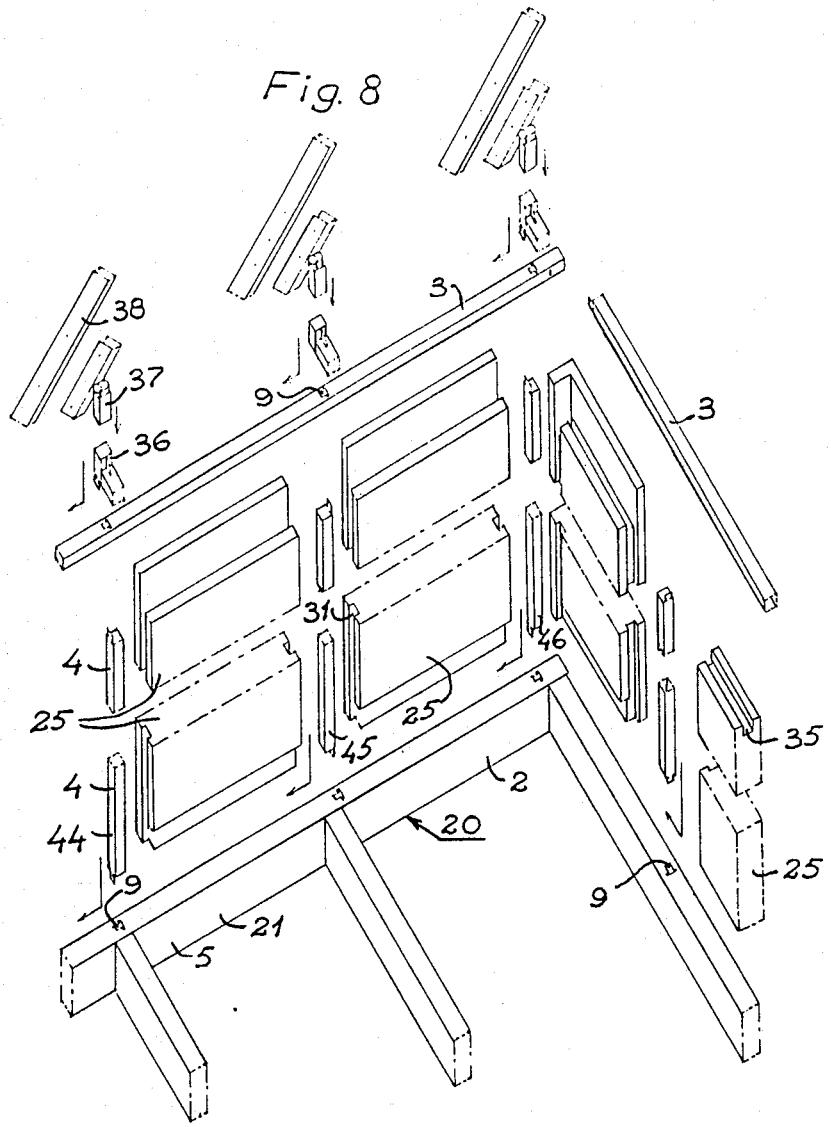
FIG. 8 shows in perspective parts for a building.

When the walls are erected, as shown for example in FIG. 8, at first an upright 4, 46 is arranged. After that a wall panel 25 is arranged against the upright and after that an upright 4, 45 is arranged against the wall panel to lock the wall panel and further a wall panel and an upright 4, 44 are arranged, whereby one ought to watch the turning of the uprights of theirs surface 6 in order to connect an upright to a wall panel and/or to lock a wall panel.

To enlargement of the building or connection of horizontal beam members 30 to the uprights the vertical arranged uprights 4 show recesses 29 longitudinally of the uprights, whereby the horizontal beam members can show engagement parts 34 in form of hooking or catching devices which are arranged to be brought into engagement with the recesses 29, i.e. for example an utlization of the same locking method as described above in connection with frames and beams. The horizontal beam members 30 are arranged for, for example, holding windows or similar strutural elements. Windows and doors can be fasten directly to the framework for example by means of self-threded screws. It is also possible to fasten the windows and doors to the framework by means of foam. The uprights 4 are locked by means of an upper beam, i.e. the upper frame 3 which also is used as a fasten device for inter alia roof trusses. Beams of the system of joists are arranged to the upper frame 3 right opposite the uprights 4. Roof trusses 38 or portions 37 of roof trusses are arranged by means of fastening elemetns 36 which are arranged to recesses 9 of the upper frame 3 in conformity with the fastening of uprights into the frames, whereby a frame or a beam of a roof truss can be arranged into the fastening element 36.

Figure 7:
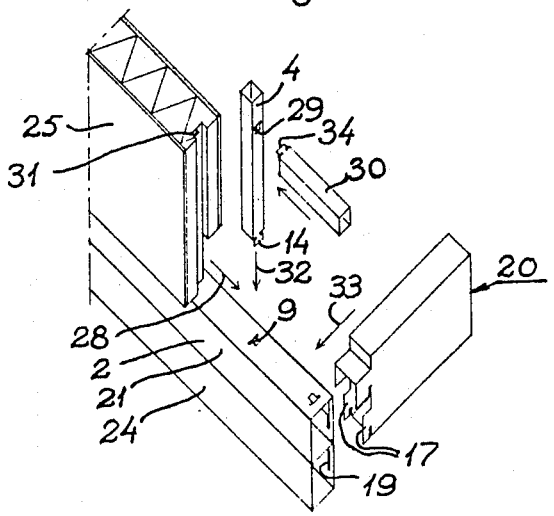
FIG. 7 shows in perspective a part of a building according to the invention.

FIG. 4 and FIG. 5 show the possibility of connection and anchoring or locking of the uprights to the beams or similar. With further reference to FIGS. 2 and 7 (FIG. 8) an engagement element 14 is brought into the lower frame 2, beam or sill through a recess 9 shown by the frame and the upright is after that displaced to an end position 48. An upright 46 is locked by an adjacent wall panel 25 or a specially locking device. Next upright 45 can be arranged in the same way or be directed with its opposite surface to the edge joint of wall panel before the introduction into the recess 9 and the displacement against the wall panel, whereby the upright is stabilized and prevented from a tip movement from the wall panel. If every second upright or every second pair of uprights are arranged in such a way each wall panel is going to be locked between the uprights. The framework including frames and uprights is also stabilized by said arrangement. Thus, the uprights are able to tip in one direction, i.e. in the direction of the upright which shows the engagement element 14. In the opposite direction the tilting of the upright is prevented by the upright itself by its end edge 50 which rests on the foundation 20 or the frame 2. The upright cannot tip in the directions perpendicular to the directions said before depending on the form of the engagement elements. Thus, one can choose one of two directions in which the upright is meant to be able to tip or vice versa, cannot tip, in order to attain the very best stabilization. But the recess 9 or every second recess in the frames must be dislocated one breadth of an upright so that the index between the uprights is going to be the intended and current, for example 1200 mm. When the uprights are arranged the index between the uprights shall be equal between the uprights especially in each wall. When the uprights are arranged in the same direction the uprights will be located according to the index, i.e. the recesses are located in the same index and directed towards the same direction. This is evident from the nearest lower frame in FIG. 1. See also the direction of the arrows 8. The dislocation of the recesses is evident from other figures. Both sills 2 and capping plates 3 for each wall can be divided or at least one capping plate which is intended to be arranged in the end. Depending on the fact that one shall be able to connect the frame and have the frame to pass the joining means of the frames arranged in adjacent walls, one can be forced to divide the frames. Thus, the frames can be in parts with joint means arranged into the frames, for example formed as a telescopic body, or be formed as telescopic tubes. This promotes also the delivering and stock-keeping of the profiles.

When the first wall is erected an adjacent wall is erected and so on until the last wall panel is arranged. The upper frames 3 or capping plates are arranged as the walls or wall panels are erected.

When utilization of uprights having engagment elements showing an directed ear or similar one managees in the same way, whereby the upright can be arranged elastic which promotes the locking or the keeping of the upright during the assemblage of the upright.

According to one embodiment, the embodiment in which the frames show the open profiles, specially tie irons can be used to anchor the lower frame into the bedding or the foundation and fastening of lower beams of the roof trusses, whereby the tie irons are used in pairs, each on one side of the lower frame of the roof truss. A web or a portion of the tie irons is introduced into the profiles and hooked to the profiles in which the tie irons can be adjusted by displacement to a suitable position.

Locking devices, pins, clamps or similar, if any, between the ends of the frames are arranged only to join parts of the framework during the erecting of the framework. The framework is than stabilized and rigidified by the lower frame of the roof trusses. The framework is also stabilized and rigidified by the upper frames or capping plates if upper frames and capping plates are arranged in the wall or into upper recesses of the wall panels. The parts of the frames which shall be arranged in the long walls of the building are arranged to overlap the ends of adjacent parts of the frames arranged in the short walls of the building.

The beams and frames in which uprights of the framework shall be anchored show recesses, for example formed as T-shaped recesses.

Without exceeding the scope of the concept of the invention modifications of the building in accordance with the invention should be possible. Thus, the beams can be of another kind of shape and also show other joining means or be without joining means and instead be joined in a more conventional way by welding or similar. Of course, the construction can be changed from a primary construction (a construction taking up dead load and exterior load) to a secondary construction (a construction taking up dead load and wind load). This means that the arrangement also is suitable as lattice walls or similar constructions.

The construction of the building can be an another as well as that wall panels, the foundation and other system of joists can be formed in an another way and furnished with supplementary interior mountings and/or exterior mountings. Whichever intended and suitable building can be erected upon the foundation. The engagement elements and other engagement devices, joining means and locking devices can be of an another and suitable kind. It is not necessary that the beams must show recesses for the fastening of the uprights which instead can be arranged to the beams in a more conventional way. Of course, the system of joists can be of customary kind and be arranged upon the foundation and the beams can also be used for arranging upon an another base as for example a system of joists for a cellar, moulded base plates, etc. The foundation is especially advantageous when used in connection with a simple bedding of shingle, whereby the greatest advantages in simpleness is won which also concerns the suggested form of uprights, beams, buildings, etc. The building are thus not restricted to what has been described and illustrated in the embodiments but soley by the following claims.

What is claimed is:

1. A building framework comprising:

a lower frame consisting of horizontally extending beams, an upper frame also consisting of horizontally extending beams, and a plurality of uprights extending from the lower frame to the upper frame and connected thereto, in which at least parts of the lengths of the horizontally extending beams of the lower frame are in the form of open channels having overhanging flange means, and in which the uprights have means at their lower ends projecting into the channels and behind the overhanging flange means, the uprights being horizontally movable relative to the lower frame members along the lengths thereof during assembly, while being prevented from removal from the lower frame members by engagement of the projecting means with said overhanging flange means, characterized in that said uprights are formed of metal channels and in that said projecting means at the lower end of each upright protrudes downwardly as an extension of one side wall of the upright, which faces in a direction along the length of the lower frame beam to which the upright is connected.

2. A building framework in accordance with claim 1, characterized by roof trusses rigidly connected to the upper frame.

3. A building framework in accordance with claim 1, characterized by insulated wall panels and by insulated load bearing panels forming a floor, the perimeter of said bearing panels being adjacent to the wall panels.

4. A building framework in accordance with claim 1, characterized by a foundation arranged upon a bedding comprising a compressed shingle and a thin layer of concrete for levelling the foundation.

* * * * *